US006808367B1

(12) United States Patent
Liang

(10) Patent No.: US 6,808,367 B1
(45) Date of Patent: Oct. 26, 2004

(54) COOLING SYSTEM FOR A TURBINE BLADE HAVING A DOUBLE OUTER WALL

(75) Inventor: George Liang, Palm City, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/457,505

(22) Filed: Jun. 9, 2003

(51) Int. Cl.[7] ..... B63H 1/14
(52) U.S. Cl. ..... 416/97 R; 415/115; 415/116
(58) Field of Search ..... 416/97 R, 97 A; 415/115, 116

(56) References Cited

U.S. PATENT DOCUMENTS

| | | | | |
|---|---|---|---|---|
| 3,628,885 A | | 12/1971 | Sidenstick et al. | |
| 4,407,632 A | | 10/1983 | Liang | |
| 4,775,296 A | | 10/1988 | Schwarzmann et al. | |
| 4,786,233 A | | 11/1988 | Shizuya et al. | |
| 5,403,159 A | * | 4/1995 | Green et al. | 416/97 R |
| 5,484,258 A | * | 1/1996 | Isburgh et al. | 415/115 |
| 5,695,320 A | | 12/1997 | Kercher | |
| 5,695,321 A | | 12/1997 | Kercher | |
| 5,700,132 A | | 12/1997 | Lampes et al. | |
| 5,738,493 A | | 4/1998 | Lee et al. | |
| 5,810,552 A | * | 9/1998 | Frasier | 415/115 |
| 5,931,638 A | * | 8/1999 | Krause et al. | 416/97 R |
| 6,179,565 B1 | * | 1/2001 | Palumbo et al. | 416/97 R |
| 6,234,754 B1 | * | 5/2001 | Zelesky et al. | 416/97 R |
| 6,254,334 B1 | | 7/2001 | LaFleur | |
| 6,514,042 B2 | | 2/2003 | Kvasnak et al. | |

* cited by examiner

*Primary Examiner*—Hoang M. Nguyen

(57) ABSTRACT

A turbine blade for a turbine engine having a double wall having one or more cavities forming a cooling system. The cavity may include a plurality of pedestals and protrusions configured to create one or more spirals flow paths of a gas traveling through the cavity. The cavity may receive a gas from the root of the blade. The gas may be passed through the cavity in the double wall and may be expelled from the cavity.

20 Claims, 3 Drawing Sheets

COOLING SYSTEM FOR A TURBINE BLADE HAVING A DOUBLE OUTER WALL

FIELD OF THE INVENTION

This invention is directed generally to turbine blades, and more particularly to hollow turbine blades having an intricate maze of cooling channels for passing fluids, such as air, to cool the blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Operation of a turbine engine results is high stresses being generated in numerous areas of a turbine blade. Some turbine blades have outer walls, referred to herein as housings, formed from double walls, such as an inner wall and an outer wall. Typically, cooling air flows through a cavity defined by the inner and outer walls to cool the outer wall. However, uneven heating in the inner and outer walls of a turbine blade still often exists.

Thus, a need exists for a turbine blade that effectively dissipates heat in a turbine blade.

SUMMARY OF THE INVENTION

This invention relates to a turbine blade capable of being used in turbine engines and having a cooling system including, at least, a cavity positioned between two or more walls forming a housing of the turbine blade. The turbine blade may be formed from a generally elongated blade and a root coupled to the blade. The blade may have an outside surface configured to be operable in a turbine engine and may include a leading edge, a trailing edge, a tip at a first end, and one or more cavities forming a cooling system. The root may be coupled to the blade at an end generally opposite the first end for supporting the blade and for coupling the blade to a disc.

The cooling system may include a cavity defined by an inner wall and an outer wall forming the housing of the blade and a main cavity forming a substantial portion of the inner aspects of the blade inside the inner wall of the housing of the blade. The main cavity may have any shape sufficient to provide cooling gas to various portions of the blade; however, this invention is not limited by the shape of the main cavity. The cavity defined by the inner wall and the outer wall may include one or more protrusions or one or more pedestals, or both, for increasing the rate of convection of the cooling system. In at least one embodiment, the cavity may include a plurality of pedestals extending from the inner wall to the outer wall. The pedestals may be positioned in the cavity in a plurality of rows or in other manners. The rows may be generally parallel with a longitudinal axis of the blade, may be generally orthogonal to a direction of an average flow of gas through the cavity, or may be positioned in other manners. In one or more embodiments, the pedestals in a second row may be offset relative to pedestals in a first row immediately upstream from the second row.

The cavity positioned between the inner and outer walls forming the housing may also include one or more protrusions. The protrusions, which may also be referred to as fences, may introduce turbulence to a gas flowing through the cavity. The protrusions may be positioned generally parallel with the longitudinal axis of the blade, may be generally orthogonal to a direction of an average flow of gas through the cavity, or may be positioned in other manners. In at least one embodiment, the protrusions may be positioned between pedestals. The protrusions may be positioned between each pedestal in a row of pedestals or only between a portion of the pedestals forming a row.

In at least one embodiment, the cavity may include a first row of pedestals having protrusions positioned between at least two pedestals. The protrusions may be coupled to an inner wall of the housing. The cavity may further include a second row of pedestals positioned immediately downstream from the first row and generally parallel to the first row. The first and second row may be positioned generally parallel to the longitudinal axis of the blade, may be generally orthogonal to a direction of an average flow of gas through the cavity, or may be positioned in other manners. The second row of pedestals may include one or more protrusions positioned between the pedestals and attached to the outer wall of the housing. Alternatively, the first row may have protrusions attached to the outer wall and the second row may have protrusions attached to the inner wall. This pattern may continue for a portion or all of the cavity located between the outer and inner walls forming the housing.

The pedestals in the second row may be offset from the pedestals in the first row. By offsetting the pedestals in the second row relative to the pedestals in the first row positioned upstream from the second row and by alternating the protrusions from the inner wall to the outer wall, or vice versa, a spiral flow of gas may be created in the cavity. The spiral flow increases the rate of convection and thus increases the cooling capacity of the cooling system. In addition, by including a protrusion in the first row of pedestals, turbulence is induced immediately to the flow of gas entering the cavity. Because turbulence increases the rate of convection, the turbulent action created by the protrusions in the first row increases the rate of convection of the cooling system. These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
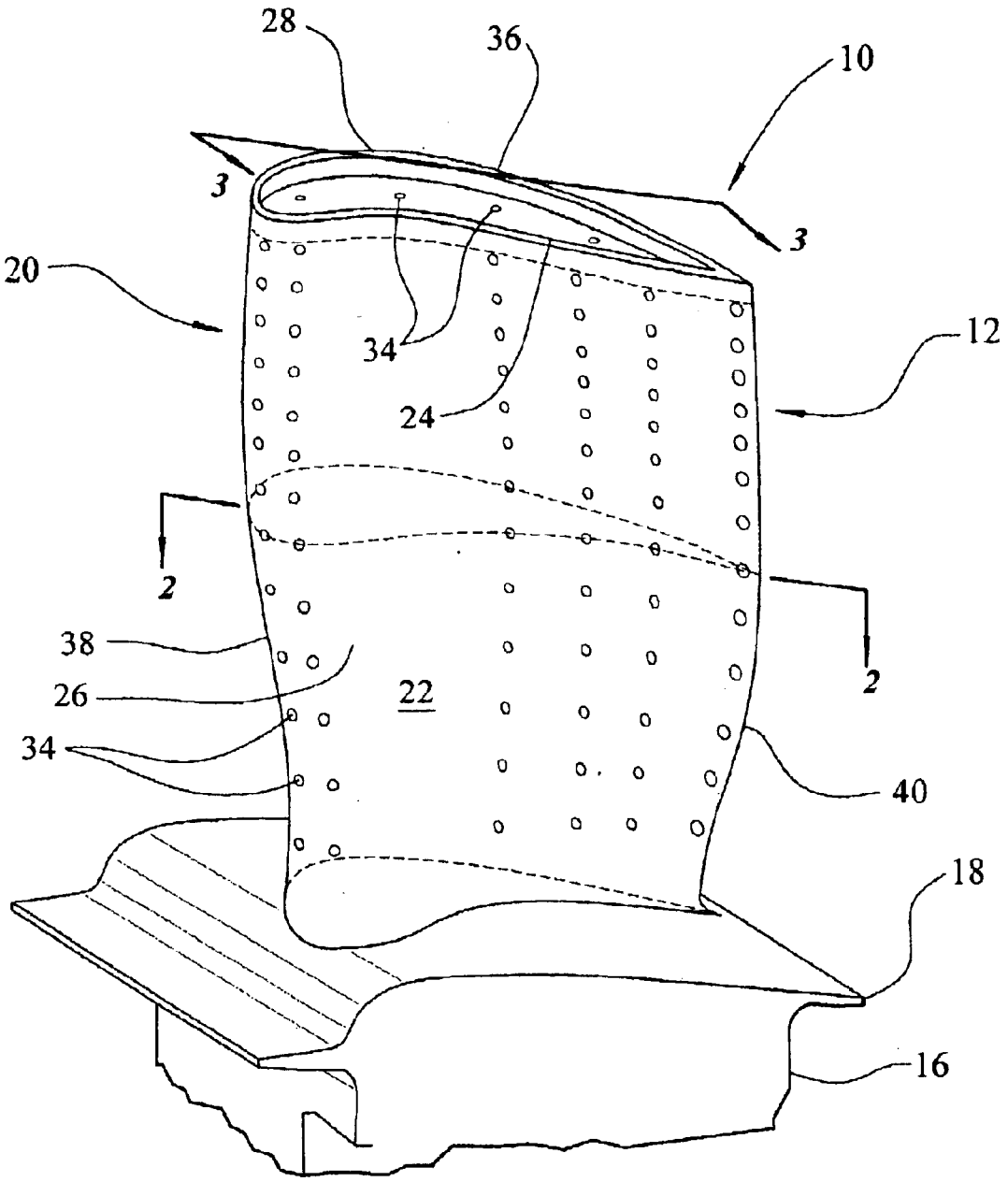
FIG. 1 is a perspective view of a turbine blade having features according to the instant invention.
Figure 2:
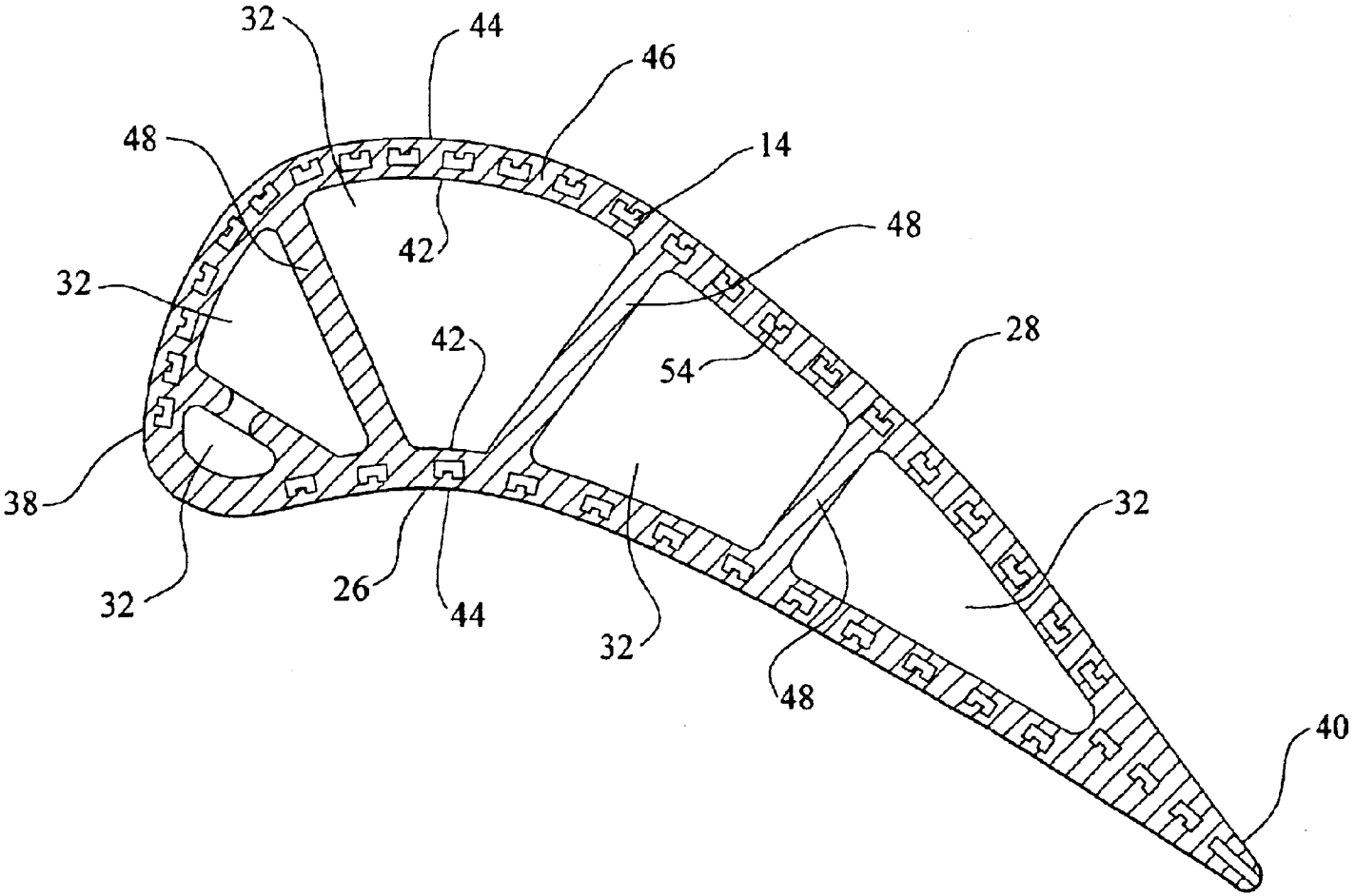
FIG. 2 is cross-sectional view of the turbine blade shown in FIG. 1 taken along line 2—2.

As shown in FIGS. 1–5, this invention is directed to a turbine blade cooling system 10 for turbine blades 12 used in turbine engines. In particular, turbine blade cooling system 10 is directed to a cooling system located in a cavity 14, as shown in FIG. 2, positioned between two or more walls forming a housing 24 of the turbine blade 12. As shown in FIG. 1, the turbine blade 12 may be formed from a root 16 having a platform 18 and a generally elongated blade 20 coupled to the root 16 at the platform 18. Blade 20 may have an outer surface 22 adapted for use, for example, in a first stage of an axial flow turbine engine. Outer surface 22 may be formed from a housing 24 having a generally concave shaped portion forming pressure side 26 and may have a generally convex shaped portion forming suction side 28. The blade 20 may include one or more main cavities 32 positioned in inner aspects of the blade 20 for directing one or more gases, which may include air received from a compressor (not shown), through the blade 20 and out of one or more orifices 34 in the blade 20. As shown in FIG. 1, the orifices 34 may be positioned in a tip 36, a leading edge 38, or a trailing edge 40, or any combination thereof, and have various configurations.

The main cavity 32 may be arranged in various configurations. For instance, as shown in FIG. 2, the main cavity 32 may form cooling chambers that extend through root 16 and blade 20. In particular, the main cavity 32 may extend from the tip 36 to one or more orifices (not shown) in the root 16. Alternatively, the main cavity 32 may be formed only in portions of the root 16 and the blade 20. The main cavity 32 may be configured to receive a cooling gas, such as air, from the compressor (not shown). The main cavity 32 is not limited to the configuration shown in FIG. 2, but may have other configurations as well.

Figure 3:
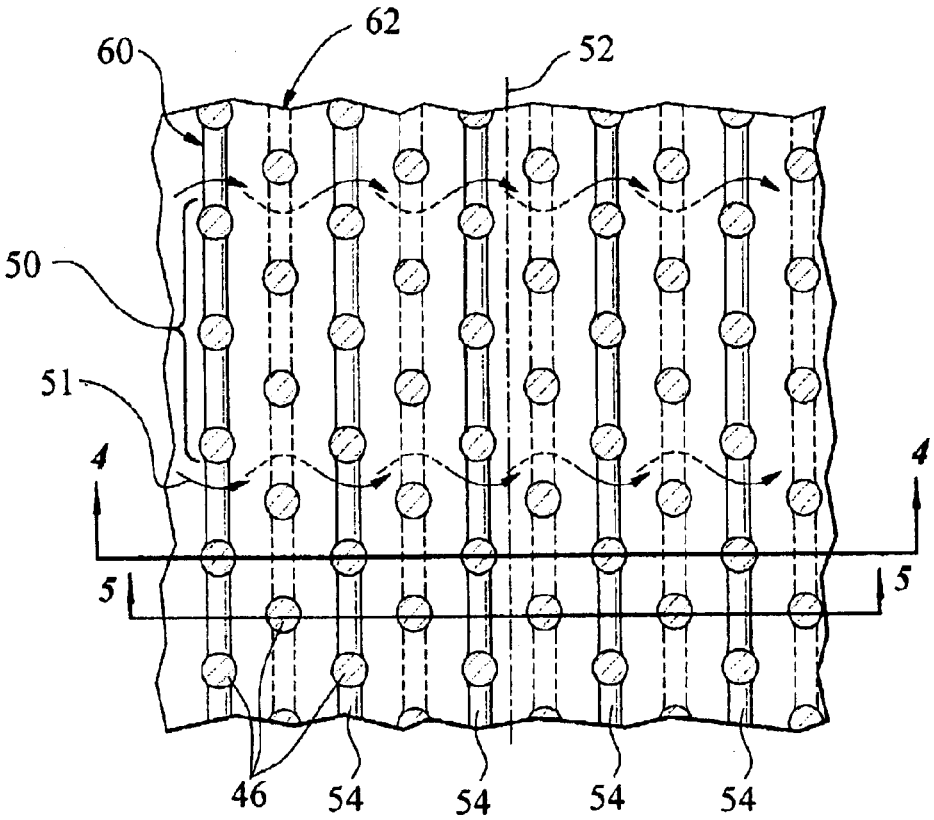
FIG. 3 is a cross-sectional view, referred to as a filleted view, of the turbine blade shown in FIG. 1 taken along line 3—3.

As previously mentioned, the housing 24 may be composed of two or more walls. As shown in FIG. 2, the housing 24 may be formed from an inner wall 42 and an outer wall 44. The inner wall 42 may be configured to generally follow the contours of the outer wall 44 yet form cavity 14 between the inner wall 42 and the outer wall 44. The inner wall 42 may be held in place relative to the outer wall 44 using a plurality of pedestals 46. The pedestals 46 may extend from the inner wall 42 to the outer wall 44. The inner wall 42 may also be supported by one or more ribs 48 positioned in the main cavity 32. The inner wall 42 is positioned relative to the outer wall 44 so that the cavity 14 has sufficient cross-sectional area to allow sufficient gas flow through the cavity to cool the inner and outer walls, 42 and 44 respectively. The pedestals 46 may have a cylindrical cross-section, as shown in FIG. 3. Alternatively, the pedestals 46 may have other shaped cross-sections, such as, but not limited to, triangular, rectangular, elliptical, oval, star-shaped, or other shape.

As shown in FIG. 3, the pedestals 46 may be positioned in rows 50 that are generally parallel to a longitudinal axis 52 of the blade 20. In other embodiments, the rows 50 may be positioned generally orthogonal to a direction of an average flow of a gas 51 through the cavity 14. In at least one embodiment, as shown in FIG. 3, pedestals 46 in adjacent rows may be offset relative to pedestals 46 in an adjacent row. In at least one embodiment, the pedestals 46 may be offset along the longitudinal axis 52 of the blade 20. In other embodiments, the pedestals 46 may be offset along a line generally orthogonal to a direction of an average flow of gas 51 through the cavity 14. The blade 20 may contain two or more rows 50 of pedestals 46. In at least one embodiment, the blade 20 may contain rows 50 of pedestals 46 on the pressure side 26 and the suction side 28 of the blade. In other embodiments, the blade 20 may contain rows 50 of pedestals 46 only in the pressure side 26, the suction side 28, the leading edge 38, or the trailing edge 40.

The cavity 14 may also include one or more protrusions 54, which may also be referred to as fences. The protrusions 54 may extend into the cavity 14 from the inner wall 42 or the outer wall 44, or both. In at least one embodiment, the protrusions 54 may extend from the inner wall 42 or the outer wall 44, or both, generally orthogonal to the surface of the inner or outer walls 42 or 44. The protrusions 54 may include fillets 56 at the intersection between the protrusion 54 and the inner or outer walls 42 or 44. In other embodiments, the protrusions 54 may extend from the inner wall 42 or outer wall 44 at an angle other than about 90 degrees relative to the inner wall 42 or the outer wall 44. The height of the protrusions 54 may vary depending on the desired flow rate through the cavity 14. In at least one embodiment, the height of at least some of the protrusions 54 may be about ½ of the distance 58 between the inner wall 42 and the outer wall 44.

Figure 4:
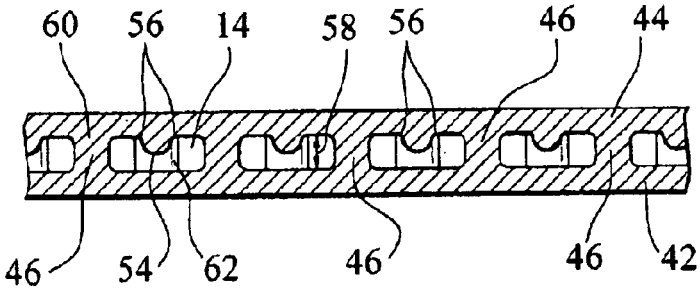
FIG. 4 is a cross-sectional view of the turbine blade shown in FIG. 3 taken along line 4—4.
Figure 5:
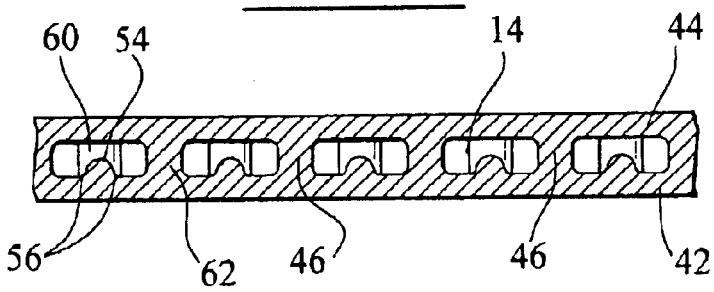
FIG. 5 is a cross-sectional view of the turbine blade shown in FIG. 3 taken along line 5—5.

The protrusions 54 may be positioned between adjacent pedestals 46. In some embodiments, the protrusions 54 may be positioned between each pedestals 54 in a row 50 or may be positioned between only a portion of the pedestals 54 in a row 50. In at least one embodiment, as shown in FIGS. 3–5, the protrusions 54 may alternate positions between the inner wall 42 and the outer wall 44 in adjacent rows 50 of pedestals. As shown in FIG. 3, the protrusions 54 may be positioned between the pedestals 46 along the row 50 of pedestals. The protrusions 54 in a first row 60 of pedestals 46 may be located on the inner wall 42, as shown in FIGS. 3 and 5. The protrusions 54 on a second row 62 of pedestals 46 located immediately downstream from the first row 60 may include two or more pedestals 46 having protrusions 54 positioned between the pedestals 46 and attached to the outer wall 44, as shown in FIGS. 3 and 4. The protrusions 54 positioned attached to outer wall in FIG. 3 are shown as dashed lines and represent the position of the protrusions 54 in a fully assembled blade 20. This pattern of alternating protrusions from the inner wall 42 to the outer wall 44 may continue downstream for one or more rows 50 of pedestals 46 and may be found throughout the cavity 14.

In addition, as shown in FIG. 3, the pedestals 46 in the second row 62 may be offset from the pedestals 46 in the first row 60. Additionally, the pedestals 46 in the rows 50 downstream of the second row 62 may be offset from the pedestals in the second row 62, and this pattern may continue throughout the cavity 14. As previously mentioned, the pedestals 46 may be offset along the longitudinal axis 52 of the blade 20 or along a line generally orthogonal to a direction of an average flow of gas 51 through the cavity 14. By offsetting the pedestals 46 in the second row 62 relative to the pedestals 46 in the first row 60 and alternating the protrusions 54 from the inner wall 42 to the outer wall 44 in adjacent rows 50, a gas passing the first and second rows 60 and 62 forms a spiral flow, as depicted in FIG. 3.

During operation, one or more gases are passed into main cavity 32 through orifices (not shown) in the root 16. The gases may or may not be received from a compressor (not shown). The gas flows through the main cavity 32 and cools various portions of the blade 20. The gas also passes into the cavity 14. As soon as the gas pass into the cavity 14, the gas passes over at least one protrusion 54 in the first row 60 of pedestals 46. As the gas stream passes over the protrusion 54 a turbulent flow is created immediately. The gas then flows downstream and, in the embodiment shown in FIG. 3, is redirected using a pedestal 46 in the second row 62 that is offset from the pedestals 46 in the first row 60. Thus, turbulence is introduced to the gas flow as the gas passes the first row 60 and a spiral flow begins after the gas has passed the second row 62 of pedestals 46. The spiral flow may be maintained throughout the cavity 14 until the gas is exhausted from the blade 20. The spiral flow of gas through the cavity 14 of the blade 20 increases the rate of convection, thereby increasing the cooling capacity of the cooling system 10. In addition, placing a protrusion 54 between one or more pedestals 46 in the first row 60 increases the amount of turbulent flow in the cavity 14, thereby increasing the cooling capacity of the cooling system 10.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, and a tip at a first end, a root coupled to the blade at an end generally opposite the first end for supporting the blade and for coupling the blade to a disc, a longitudinal axis extending from the tip to the root, and at least one cavity forming a cooling system in the blade;

the generally elongated blade formed from at least one outer wall and at least one inner wall, whereby the at least one inner wall and the at least one outer wall are separated by at least one outer wall cavity;

the at least one outer wall cavity including a plurality of pedestals positioned in the at least one outer wall cavity and extending from the at least one inner wall to the at least one outer wall;

at least one inner wall protrusion protruding into the at least one outer wall cavity from the at least one inner wall and extending between at least a first pedestal and a second pedestal and positioned generally parallel to the longitudinal axis of the turbine blade;

at least one outer wall protrusion protruding into the at least one outer wall cavity from the at least one outer wall and extending between at least a third pedestal and a fourth pedestal and positioned generally parallel to the longitudinal axis of the turbine blade; and wherein the third pedestal and the fourth pedestal are positioned downstream of the first and second pedestals.

2. The turbine blade of claim 1, wherein the plurality of pedestals have generally cylindrical cross-sections.

3. The turbine blade of claim 1, wherein the plurality of pedestals are positioned in two or more rows, the rows being generally orthogonal to the longitudinal axis of the turbine blade.

4. The turbine blade of claim 3, wherein the plurality of pedestals are arranged in a plurality of rows, whereby each row of pedestals is offset in a direction generally parallel to the longitudinal axis of the turbine blade relative to a row immediately upstream of the row of pedestals.

5. The turbine blade of claim 1, wherein the at least one inner wall protrusion extends from the inner wall about one half of a distance between the inner wall and the outer wall.

6. The turbine blade of claim 1, wherein the at least one outer wall protrusion extends from the outer wall about one half of a distance between the outer wall and the inner wall.

7. The turbine blade of claim 1, wherein the first and second pedestals are offset in a direction generally parallel to the longitudinal axis of the turbine blade relative to the third and forth pedestals.

8. The turbine blade of claim 1, wherein the at least one inner wall protrusion comprises a plurality of inner wall protrusions extending generally parallel to the longitudinal axis of the turbine blade, each positioned between adjacent pedestals positioned in a row that is generally parallel to the longitudinal axis of the turbine blade.

9. The turbine blade of claim 8, wherein the at least one outer wall protrusion comprises a plurality of outer wall protrusions extending generally parallel to the longitudinal axis of the turbine blade, each positioned between adjacent pedestals positioned in a row that is generally parallel to the longitudinal axis of the turbine blade.

10. The turbine blade of claim 9, wherein the plurality of outer wall protrusions are positioned in alternating rows of pedestals and the plurality of inner wall protrusions are positioned in alternating rows of pedestals not having outer wall protrusions.

11. The turbine blade of claim 1, wherein the at least one outer wall protrusion comprises a plurality of outer wall protrusions extending generally parallel to the longitudinal axis of the turbine blade, each positioned between adjacent pedestals positioned in a row that is generally parallel to the longitudinal axis of the turbine blade.

12. A turbine blade, comprising:

a generally elongated blade having a leading edge, a trailing edge, and a tip at a first end, a root coupled to the blade at an end generally opposite the first end for supporting the blade and for coupling the blade to a disc, a longitudinal axis extending from the tip to the root, and at least one cavity forming a cooling system in the blade;

the generally elongated blade formed from at least one inner wall and at least one outer wall, whereby the at least one inner wall and the at least one outer wall are separated by at least one outer wall cavity;

the at least one outer wall cavity including a plurality of pedestals positioned in the at least one outer wall cavity, extending from the at least one inner wall to the at least one outer wall, and forming a plurality of rows positioned generally parallel to the longitudinal axis of the turbine blade;

at least one inner wall protrusion protruding into the at least one outer wall cavity from the at least one inner wall and extending between pedestals positioned in a first row and positioned generally parallel to the longitudinal axis of the turbine blade; and at least one outer wall protrusion protruding into the at least one outer wall cavity from the at least one outer wall and extending between pedestals positioned in a row of pedestals positioned generally parallel to the longitudinal axis of the turbine blade and immediately downstream of the first row of pedestals.

13. The turbine blade of claim 12, wherein the plurality of pedestals have generally cylindrical cross-sections.

14. The turbine blade of claim 12, wherein each row of pedestals is offset in a direction generally parallel to the longitudinal axis of the turbine blade relative to a row immediately upstream of the row of pedestals.

15. The turbine blade of claim 12, wherein the at least one inner wall protrusion comprises a plurality of inner wall protrusions extending generally parallel to the longitudinal axis of the turbine blade, each positioned between adjacent pedestals positioned in a row that is generally parallel to the longitudinal axis of the turbine blade.

16. The turbine blade of claim 15, wherein the at least one outer wall protrusion comprises a plurality of outer wall protrusions extending generally parallel to the longitudinal axis of the turbine blade, each positioned between adjacent pedestals positioned in a row that is generally parallel to the longitudinal axis of the turbine blade.

17. The turbine blade of claim 16, wherein the plurality of outer wall protrusions are positioned in alternating rows of pedestals and the plurality of inner wall protrusions are positioned in alternating rows of pedestals not having outer wall protrusions.

18. A turbine blade, comprising:

a generally elongated blade having a leading edge, a trailing edge, and a tip at a first end, a root coupled to the blade at an end generally opposite the first end for supporting the blade and for coupling the blade to a disc, and at least one cavity forming a cooling system in the blade;

the generally elongated blade formed from at least one inner wall and at least one outer wall, whereby the at least one inner wall and the at least one outer wall are separated by at least one outer wall cavity;

the at least one outer wall cavity including a plurality of pedestals positioned in the at least one outer wall cavity, extending from the at least one inner wall to the at least one outer wall, and forming a plurality of rows positioned generally orthogonal to an average flow of gas through the at least one outer wall cavity;

at least one inner wall protrusion protruding into the at least one outer wall cavity from the at least one inner wall and extending between pedestals positioned in a first row and positioned generally orthogonal to a direction of an average flow of gas through the at least one outer wall cavity; and at least one outer wall protrusion protruding into the at least one outer wall cavity from the at least one outer wall and extending between pedestals positioned in a row of pedestals positioned generally orthogonal to a direction of an average flow of gas through the at least one outer wall cavity.

19. The turbine blade of claim 18, wherein each row of pedestals is offset in a direction generally orthogonal to a direction of an average flow of gas through the at least one outer wall cavity relative to a row immediately upstream of the row of pedestals.

20. The turbine blade of claim 18, wherein the at least one inner protrusion comprises a plurality of inner protrusions and the at least one outer protrusion comprises a plurality of outer protrusions, whereby the plurality of outer wall protrusions are positioned in alternating rows of pedestals and the plurality of inner wall protrusions are positioned in alternating rows of pedestals not having outer wall protrusions.

* * * * *